US011027286B2

(12) United States Patent
Ho

(10) Patent No.: US 11,027,286 B2
(45) Date of Patent: Jun. 8, 2021

(54) LOTTERY TICKET DESTROYING DEVICE

(71) Applicant: SAINT-FUN INTERNATIONAL CO., LTD., New Taipei (TW)

(72) Inventor: Shih-Wei Ho, New Taipei (TW)

(73) Assignee: SAINT-FUN INTERNATIONAL CO., LTD., New Taipei (TW)

( * ) Notice: Subject to any disclaimer, the term of this patent is extended or adjusted under 35 U.S.C. 154(b) by 103 days.

(21) Appl. No.: 16/677,336

(22) Filed: Nov. 7, 2019

(65) Prior Publication Data

US 2020/0122157 A1 Apr. 23, 2020

Related U.S. Application Data

(63) Continuation-in-part of application No. 15/713,719, filed on Sep. 25, 2017, now abandoned.

(51) Int. Cl.
*B02C 18/00* (2006.01)
*B02C 18/22* (2006.01)

(52) U.S. Cl.
CPC ..... *B02C 18/2216* (2013.01); *B02C 18/0007* (2013.01); *B02C 18/2283* (2013.01); *B02C 2018/0023* (2013.01); *B02C 2018/0038* (2013.01); *B02C 2018/0046* (2013.01)

(58) Field of Classification Search
CPC ..... B02C 18/0007; B02C 18/2216; B02C 18/2283; B02C 18/0046; B02C 18/0038; B02C 18/0023
See application file for complete search history.

(56) References Cited

U.S. PATENT DOCUMENTS 3,529,777 A * 9/1970 Dodson ..... D21B 1/10 241/18
3,633,831 A * 1/1972 Dodson ..... B26D 1/38 241/61
3,862,721 A * 1/1975 Flair ..... B02C 18/142 241/236
3,986,845 A * 10/1976 Hotchkiss ..... B02C 18/0007 44/636
4,172,400 A * 10/1979 Brierley ..... B02C 18/0007 83/500
4,881,690 A * 11/1989 Maier ..... B02C 18/0007 241/82.3
5,016,828 A * 5/1991 Utsumi ..... B02C 18/0007 241/158

(Continued)

*Primary Examiner* — Faye Francis
(74) *Attorney, Agent, or Firm* — Pai Patent & Trademark Law Firm; Chao-Chang David Pai

(57) ABSTRACT

A lottery ticket destroying device includes a housing, roller cutters mounted in the housing, a transmission gear set mounted on one side of the housing, a motor mounted on one side of the housing for rotating the transmission gear set to drive the roller cutters to cut lottery tickets into pieces. Each roller cutter has a plurality of helical shear grooves recessed into the roller cutter surface thereof. Each helical shear groove has a groove bottom surface, a vertical shear surface located on one side of the groove bottom surface and connected to the roller cutter surface and a chip-discharge sloping surface located on an opposite side of the groove bottom surface and connected to the roller cutter surface. Moreover, one end of the shaft of one of the roller cutters is combined with an elastic member to prevent the two roller cutters from being stuck.

6 Claims, 10 Drawing Sheets

(56) References Cited

U.S. PATENT DOCUMENTS 5,328,107 A * 7/1994 Tsai ..... B02C 18/0007 241/236
5,996,457 A * 12/1999 Wingeron, Jr. ..... B02C 18/0007 241/242
6,113,017 A * 9/2000 Tsai ..... B02C 18/0007 241/236
6,325,309 B1 * 12/2001 Chang ..... B02C 18/0007 241/101.2
6,634,577 B2 * 10/2003 Horigane ..... B02C 4/06 241/235
7,014,133 B2 * 3/2006 Ho ..... B02C 18/0007 241/100
RE40,126 E * 3/2008 Rajewski ..... B02C 18/0007 241/223
7,484,680 B2 * 2/2009 Lesar ..... B02C 18/2216 241/30
7,500,627 B2 * 3/2009 Park ..... B02C 18/0007 241/225
7,556,212 B1 * 7/2009 Huang ..... B02C 18/0007 241/33
7,644,882 B2 * 1/2010 Potts ..... B02C 18/142 241/46.06
8,113,454 B2 * 2/2012 Lin ..... B02C 18/0007 241/236
8,146,845 B2 * 4/2012 Chen ..... B02C 18/0007 241/100
8,292,204 B2 * 10/2012 Castronovo ..... B02C 19/22 241/30
8,882,011 B2 * 11/2014 Romanovich ..... B02C 18/0007 241/101.2
9,914,230 B2 * 3/2018 Weismantel ..... C08F 2/01
10,537,898 B1 * 1/2020 Davis ..... B02C 18/2225
10,821,447 B2 * 11/2020 Castronovo ..... B02C 18/148
2002/0139881 A1 * 10/2002 Hsu ..... B02C 18/142 241/236
2010/0032507 A1 * 2/2010 Chen ..... B02C 18/2291 241/34
2013/0001342 A1 * 1/2013 Romanovich ..... B02C 23/18 241/38
2015/0129691 A1 * 5/2015 Shyu ..... B02C 18/2283 241/34
2016/0338401 A1 * 11/2016 Shin ..... B02C 18/142
2019/0091697 A1 * 3/2019 Ho ..... B02C 18/2283

* cited by examiner

LOTTERY TICKET DESTROYING DEVICE

CROSS REFERENCE TO RELATED APPLICATIONS

This application is a continuation-in-part of U.S. application Ser. No. 15/713,719 filed Sep. 25, 2017. The entirety of said Application is incorporated herein by reference.

BACKGROUND OF THE INVENTION

(a) Field of the Invention

The present invention relates to shredding technology and more particularly to a lottery ticket destroying device capable of cutting every individual lottery ticket into pieces for easy destruction.

(b) Description of the Prior Art

Conventional lottery ticket destruction devices, such as Taiwan Patent Application Nos. 85208584, 85204451, and 8520923, all disclose techniques for cutting and destroying lottery tickets. These designs simply use ratchets to cut lottery tickets into three slender curled paper strips but cannot cut off a long string of lottery tickets one by one. Therefore, after cutting, the curled paper strips still have a long curled shape with an increased volume, and the longer the long string of lottery tickets, the greater the degree of curl expansion. After the long string of lottery tickets is destroyed, the waste of the curled paper strips will automatically fall into a collection cylinder. However, the collection cylinder can only store a limited number of destroyed lottery tickets. Therefore, it is necessary to repeatedly clean up the collection cylinder. This will not only increase the lottery tickets destruction work, but also greatly reduce the effectiveness of the work of destroying the lottery tickets.

To this end, the inventor of the present invention has proposed an improved lottery destruction device, as shown in the Taiwan Patent Notice M554380, which uses a motor at one side of a machine body to rotate a transmission gear set, two guide rollers and two roller cutters, so that the user can insert a long string of lottery tickets from a top insertion slot through the two guide rollers, enabling the long string of lottery tickets to be sent by the two guide rollers between the two roller cutters below, and the long string of lottery tickets is then cut obliquely into pieces and discharged downward through a shear groove structure on the surface of each of the two roller cutters.

However, the two sides of the shear groove of each of the above two roller cutters are perpendicular to the surface of the respective roller cutter, so that after each lottery ticket is cut into pieces, it will not be smoothly discharged in the shear grooves. If too much waste pieces are accumulated in the shear grooves, the cutting operation will not be smooth. In addition, the two roller cutters are driven by two passive wheels of the transmission gear set, so that the cutting edges of the two roller cutters are meshed together, and the cutting edges that are meshed together cannot be relaxed a little regardless of the forward or reverse rotation. Therefore, if two overlapping lottery tickets are accidentally inserted in between the two guide rollers, the cutting edges of the two roller cutters will be stuck by the two overlapping lottery tickets, which must be eliminated through a complicated disassembly process. To this end, how to overcome the shortcomings of the above two roller cutters is the subject of the present invention.

SUMMARY OF THE INVENTION

The present invention has been accomplished under the circumstances in view. It is one object of the present invention to provide a lottery destroying device, which uses two roller cutters in the housing thereof for cutting lottery tickets into pieces, wherein each roller cutter has a plurality of helical shear grooves recessed into the roller cutter surface thereof. Each helical shear groove has a groove bottom surface, a vertical shear surface located on one side of the groove bottom surface and connected to the roller cutter surface and a chip-discharge surface located on an opposite side of the groove bottom surface and connected to the roller cutter surface. The chip-discharge surface can improve the discharge after the lottery ticket is cut into pieces. Thereby, the lottery ticket can be cut into pieces by the vertical shear surfaces of the helical cutter grooves of the two roller cutters, and the chip-discharge surfaces of the helical shear grooves can prevent the lottery ticket chips from being caught in the helical shear grooves and facilitate downward discharge of the lottery ticket chips. The chip-discharge surface may be a sloping or a curved surface.

Preferably, the shaft of one of the two roller cutters comprises a mounting portion protruding from one side of the housing and sequentially mounted with a second driven gear of the transmission gear set, an elastic member and a retaining member. The elastic member has one end thereof abutted against the second driven gear and an opposite end thereof abutted against the retaining member. The retaining member is coupled to the mounting portion of the shaft. Thereby, the retaining member is pushed by the elastic force of one end of the elastic member, so that the retaining member pushes the roller cutter, causing one vertical shear surface of the roller cutter to mesh with one vertical shear surface of the other roller cutter. Therefore, the meshed vertical shear surfaces of the two roller cutters have room for flexible activity, which can prevent the jamming caused by two lottery tickets being simultaneously drawn into the two roller cutters.

Other advantages and features of the present invention will be fully understood by reference to the following specification in junction with the accompanying drawings, in which like reference characters denote like components of the structure.

DETAILED DESCRIPTION OF THE PREFERRED EMBODIMENTS

Figure 1:
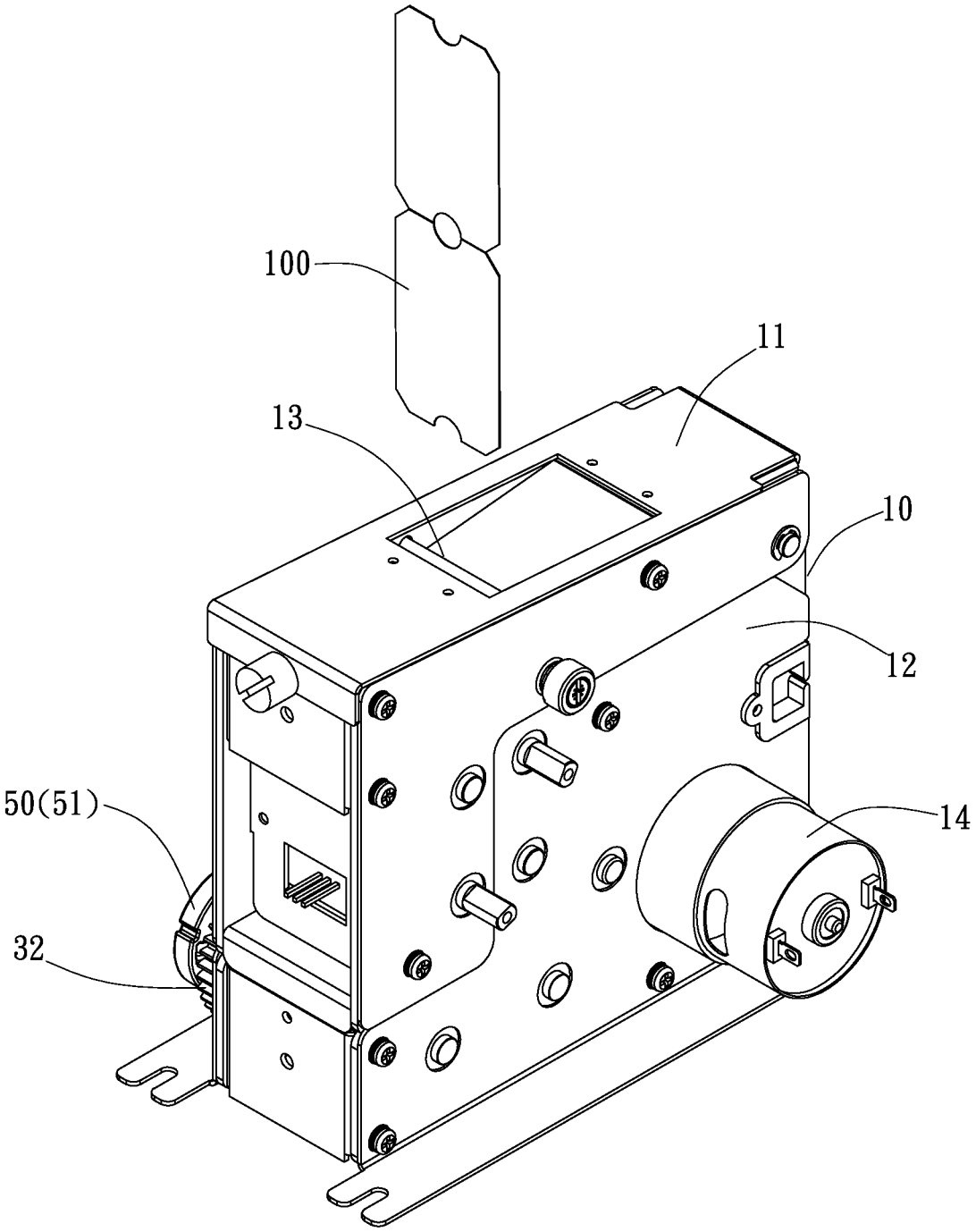
FIG. 1 is a schematic first side elevational view of a lottery ticket destroying device in accordance with the present invention.
Figure 2:
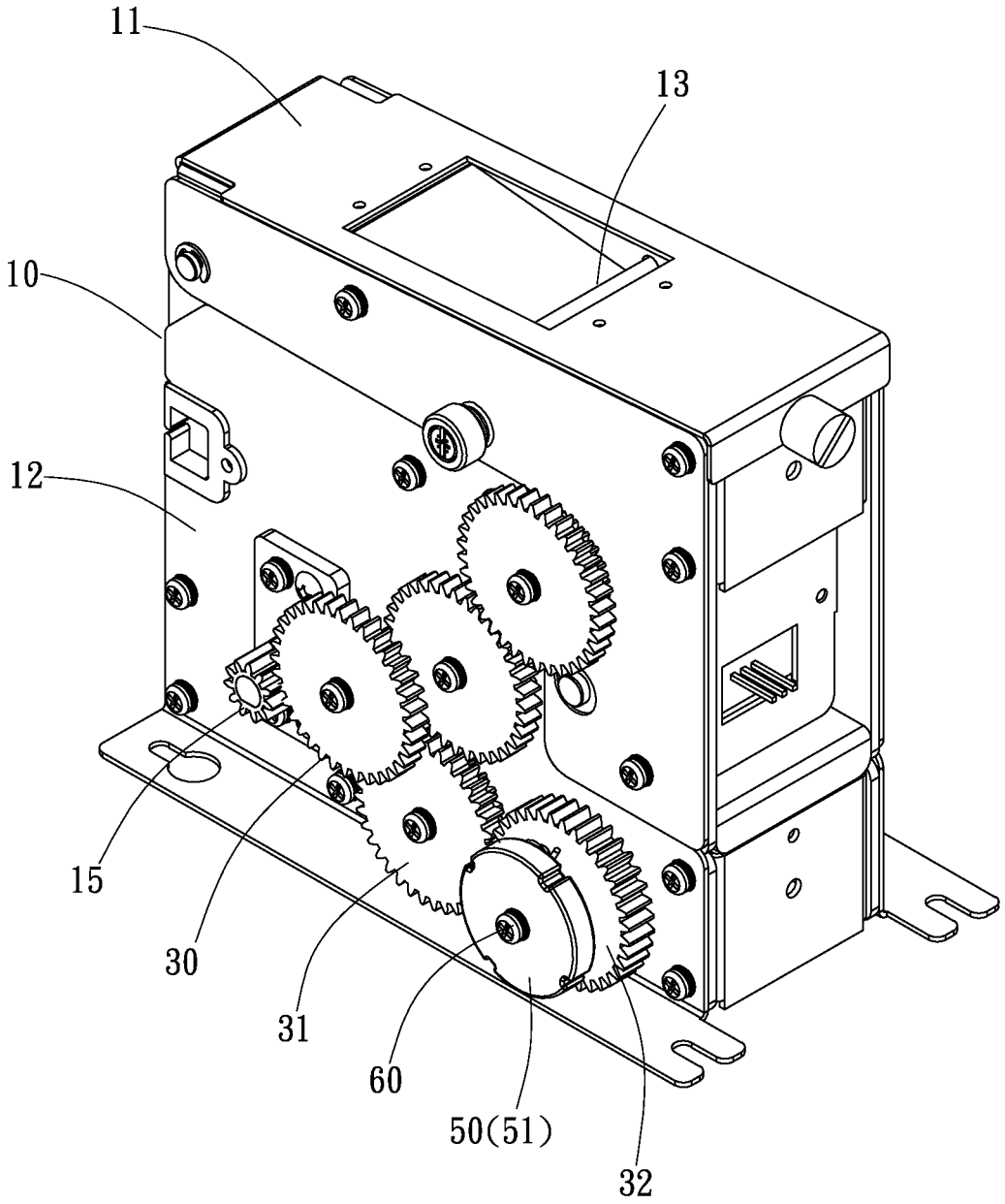
FIG. 2 is a schematic second side elevational view of the lottery ticket destroying device in accordance with the present invention.
Figure 3:
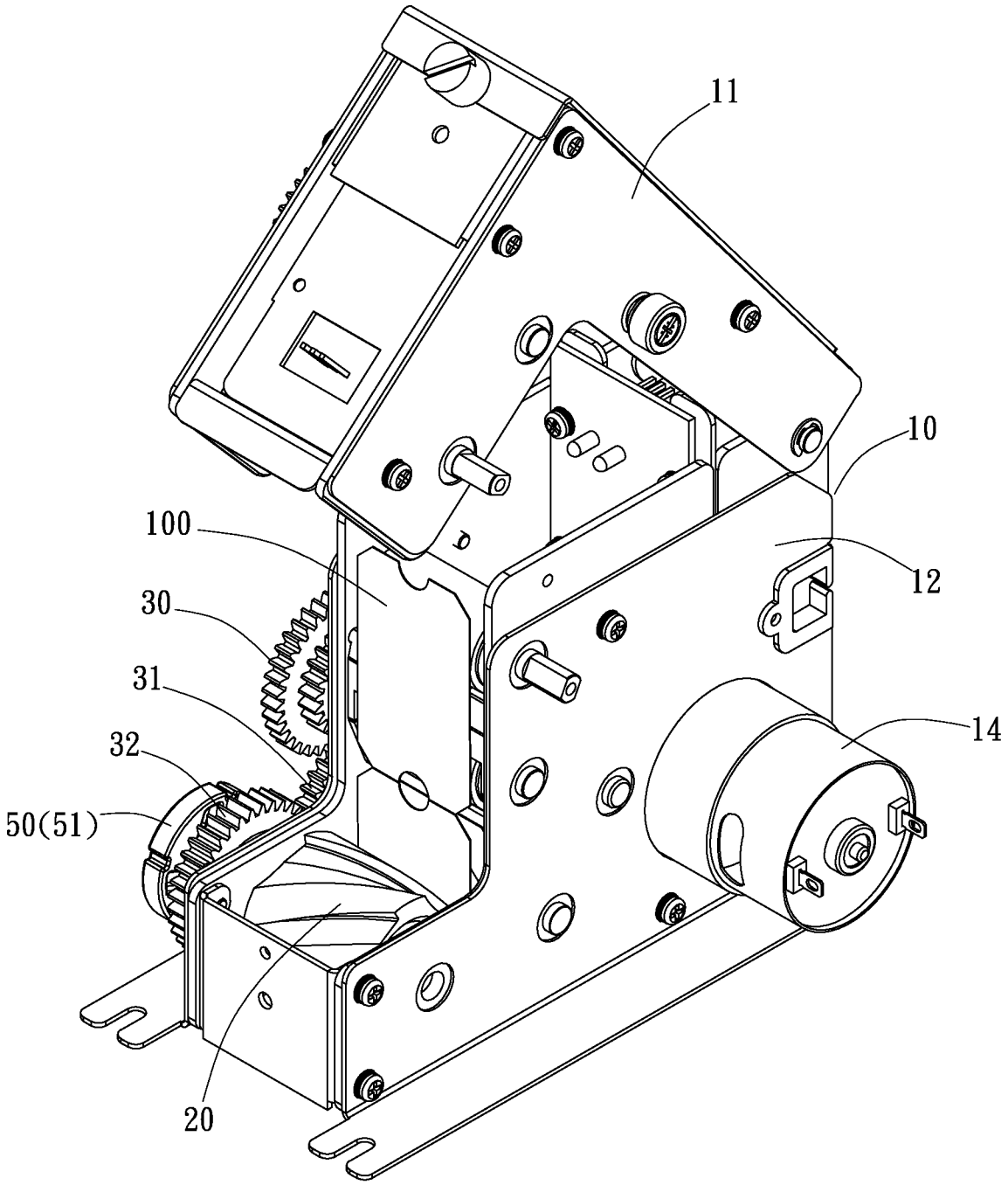
FIG. 3 illustrates an opened status of the lottery ticket destroying device of the present invention.
Figure 4:
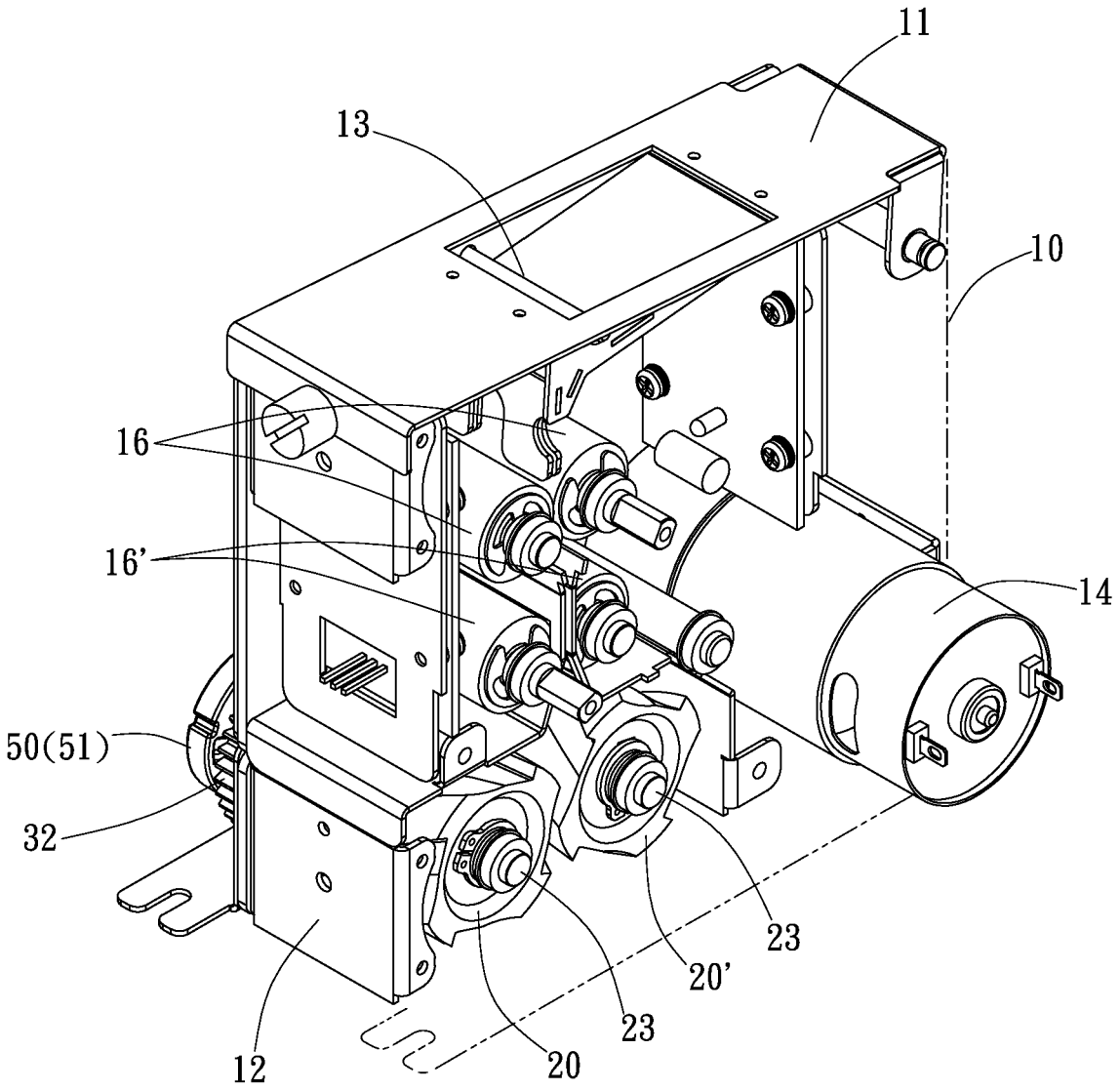
FIG. 4 is a schematic perspective view of the first side of the lottery ticket destroying device of the present invention.

Referring to FIGS. 1 and 2, a lottery ticket destroying device of the present invention is a shredding device for installing a lottery destroying machine capable of cutting lottery tickets into pieces for destruction, comprising a housing 10, two roller cutters 20,20' mounted in the housing 10 (see FIG. 4) and a transmission gear set 30 mounted on one side of the housing 10. FIGS. 3 and 4 further show that the transmission gear set 30 comprises a first driven gear 31 and a second driven gear 32 respectively mounted on the shafts 23 of the roller cutters 20',20 at one end.

Figure 5:
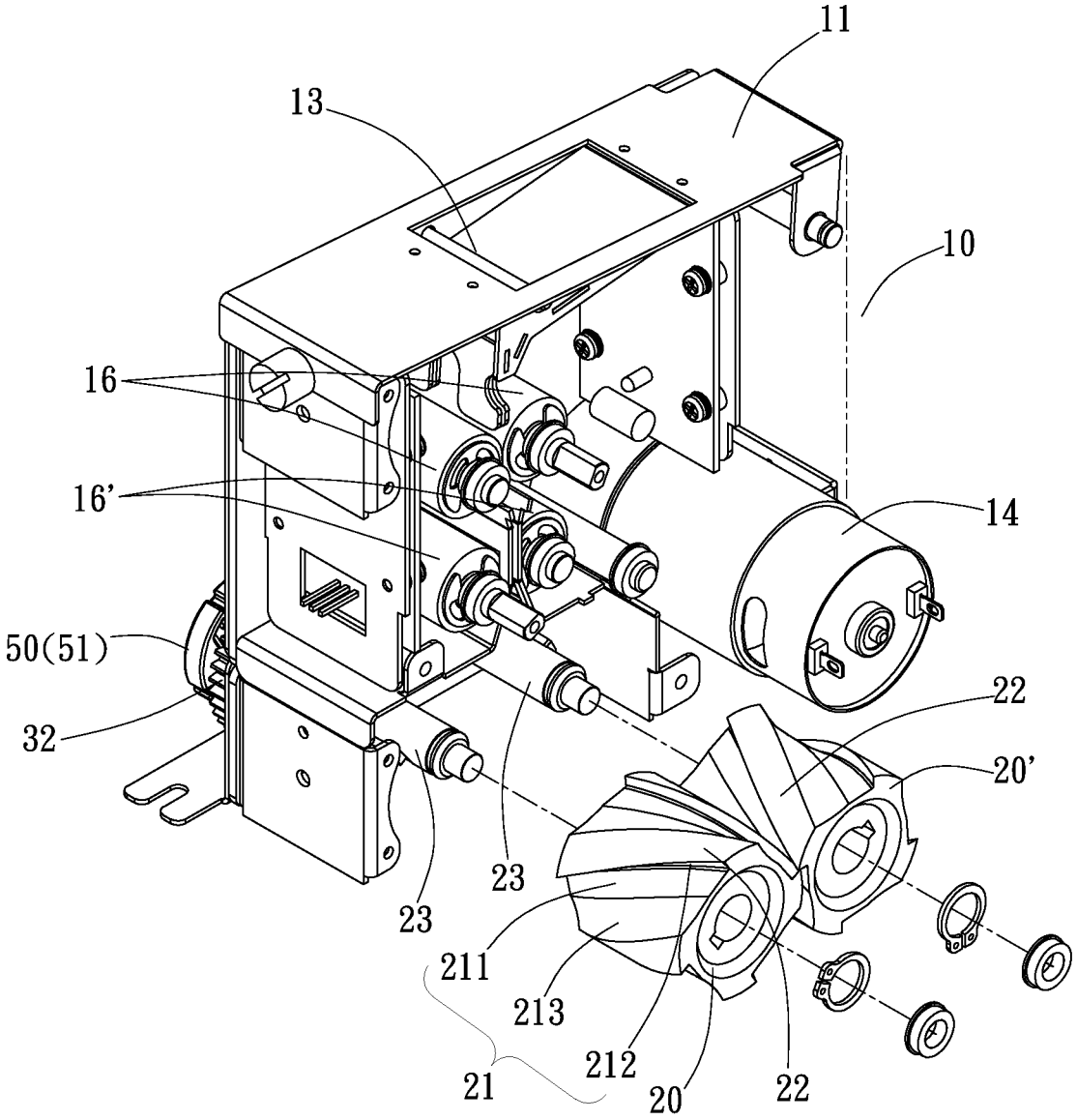
FIG. 5 is an exploded view of the roller cutters of the lottery ticket destroying device of the present invention.

As shown in FIG. 1 and FIG. 3, the housing 10 preferably comprises an upper housing member 11 and a lower housing member 12, and an pivotal joint is implemented on one end of the upper housing member 11 and the lower housing member 12 so that the other end of the upper housing member 11 can be easily opened from the lower housing member 12. The upper housing member 11 is provided with an insertion slot 13 at a top side thereof for inserting a string of lottery tickets 100. A motor 14 is mounted on one side of the lower housing member 12 for driving a drive gear 15 (as shown in FIG. 2). The drive gear 15 drives the transmission gear set 30, causing the transmission gear set 30 to drive two guide rollers 16,16' and the two roller cutters 20,20' in the housing 10 (as shown in FIG. 4 and FIG. 5). Thus, the two guide rollers 16,16' are able to roll the inserted string of lottery tickets 100 between the two roller cutters 20,20', enabling the inserted string of lottery tickets 100 to be cut into pieces by the two roller cutters 20,20'.

Figure 6:
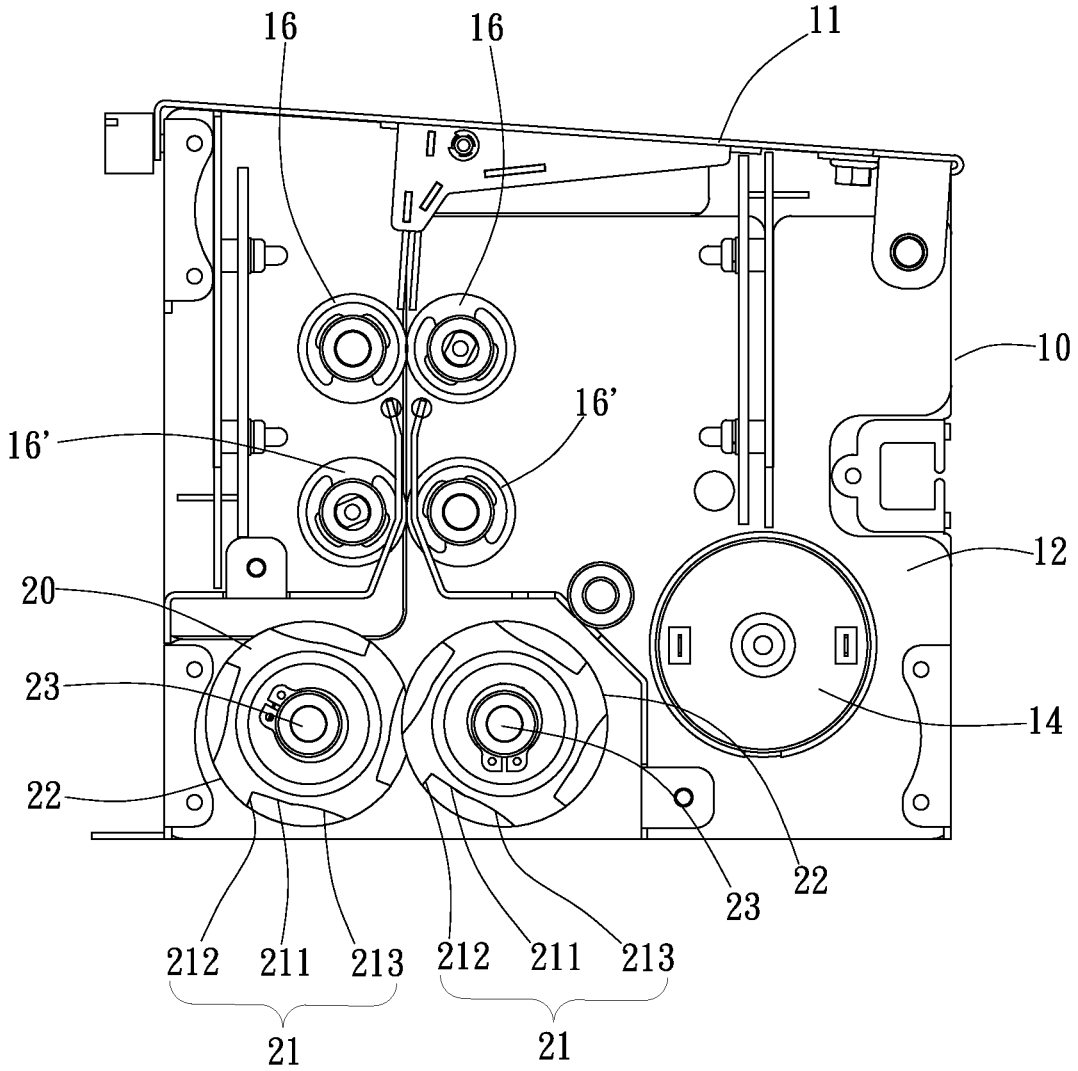
FIG. 6 is a schematic cross-sectional view of the right side of the lottery ticket destroying device of the present invention.
Figure 7:
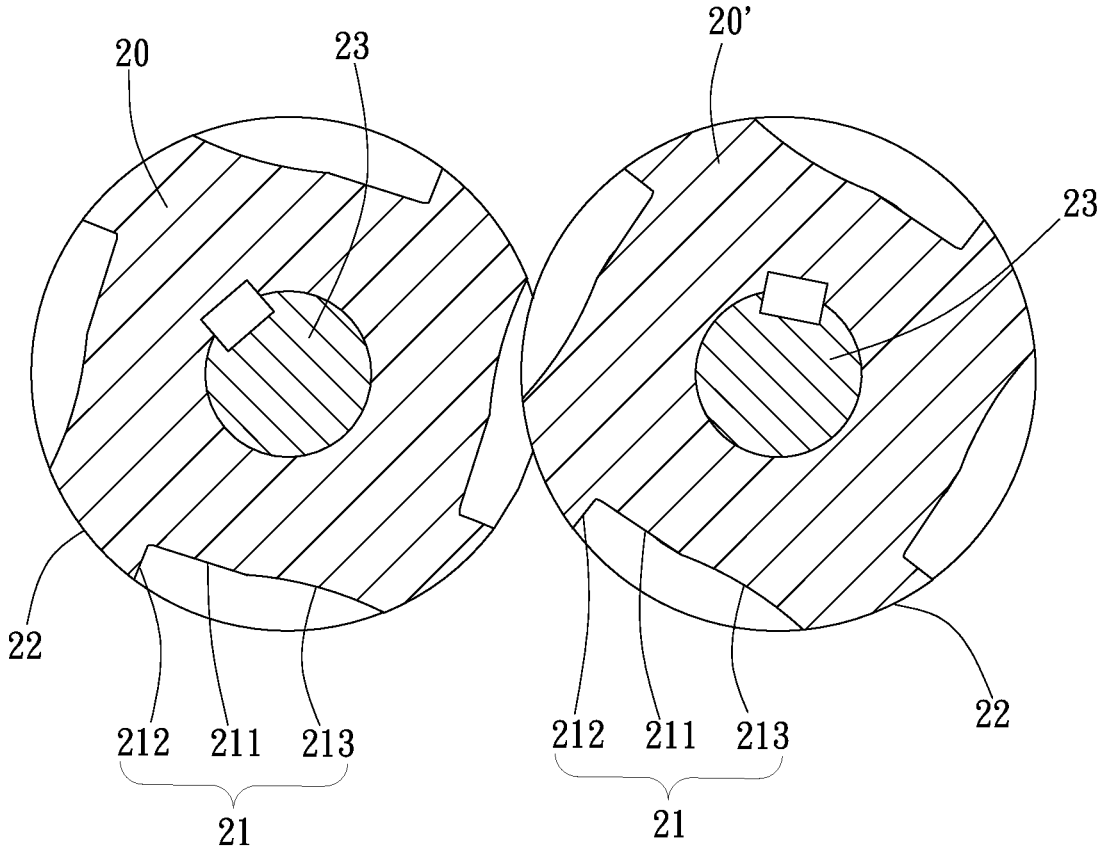
FIG. 7 is a schematic cross-sectional view of the roller cutters of the lottery ticket destroying device of the present invention.
Figure 9:
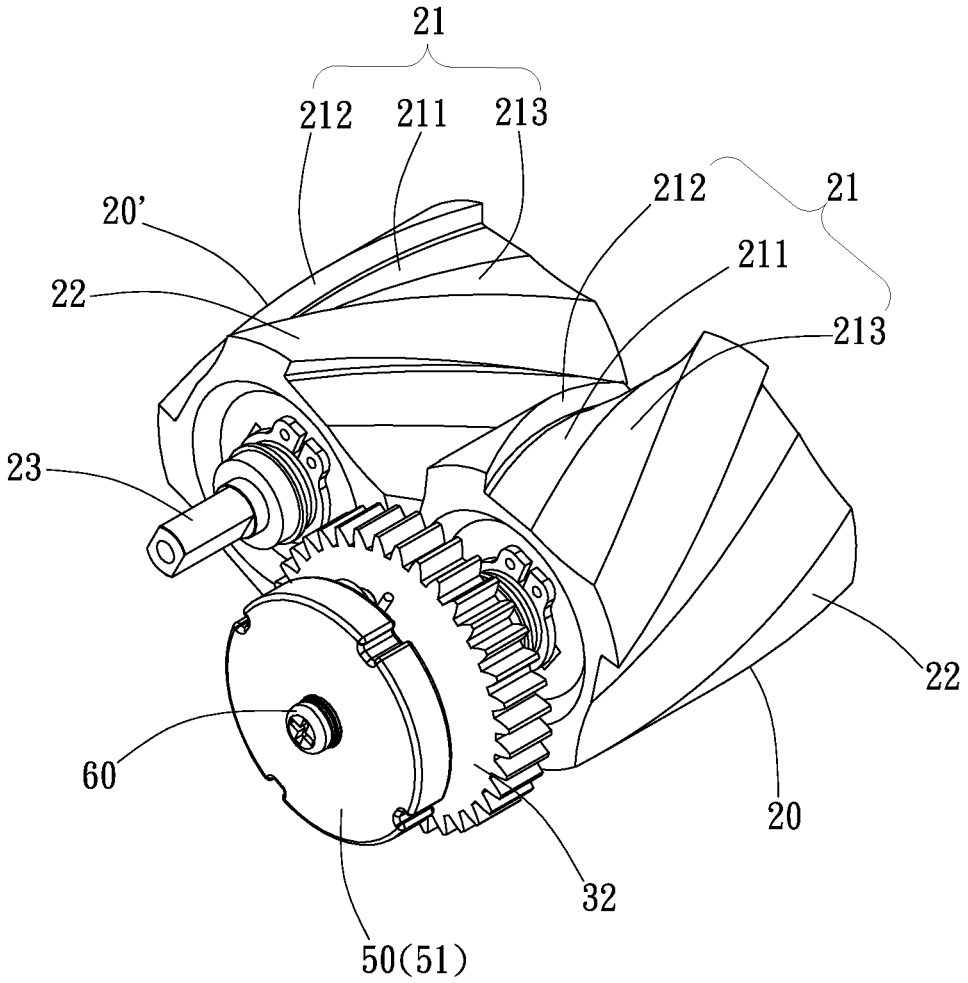
FIG. 9 is an elevational view of a part of the present invention, showing the structure of the two roller cutters of the lottery ticket destroying device.
Figure 10:
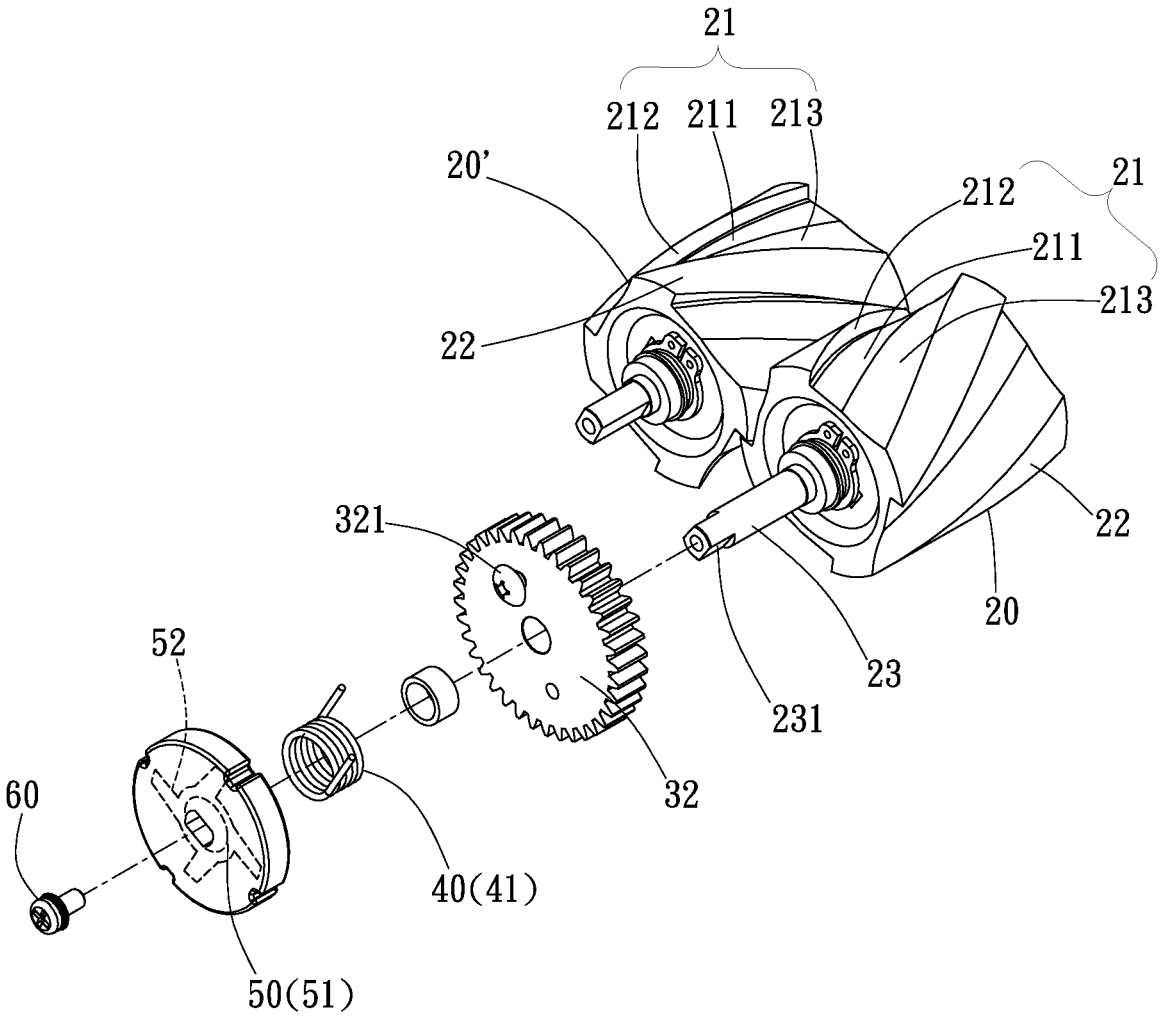
FIG. 10 is an exploded view of the elastic member and the associated roller cutter of the lottery ticket destroying device of the present invention.

Referring to FIG. 5 and FIG. 6, the center of each of the two roller cutters 20,20' is respectively disposed with a shaft 23 protruding from the two ends of the roller cutters 20,20'. Both ends of the shaft 23 of each of the two roller cutters 20,20' are rotatably disposed in the lower housing member 12 of the housing 10. Through the transmission gear set 30, the two roller cutters 20,20' are rotated synchronously. In particular, as shown in FIG. 7, FIG. 9 and FIG. 10, the surface 22 of the two roller cutters 20,20' of the present invention respectively has a plurality of helical shear grooves 21 recessed into the surface 22 of the roller cutters 20,20'. Each helical shear groove 21 comprises a groove bottom surface 211, a vertical shear surface 212 located on one side of the groove bottom surface 211 and connected to the roller cutter surface 22, and a chip-discharge sloping surface 213 located on an opposite side of the groove bottom surface 211 and connected to the roller cutter surface 22. The chip-discharge sloping surface 213 can also be replaced by a chip-discharge curved surface. Thereby, the two roller cutters 20,20' are rolled by the transmission gear set 30, so that the inserted string of lottery tickets 100 can be cut by the matching vertical shear surfaces 212 of the two roller cutters 20,20', and use the chip-discharge sloping surfaces 213 to help discharge the chips of the string of lottery tickets downwards, while preventing the lottery chips from being stuck in the helical shear grooves 21.

Figure 8:
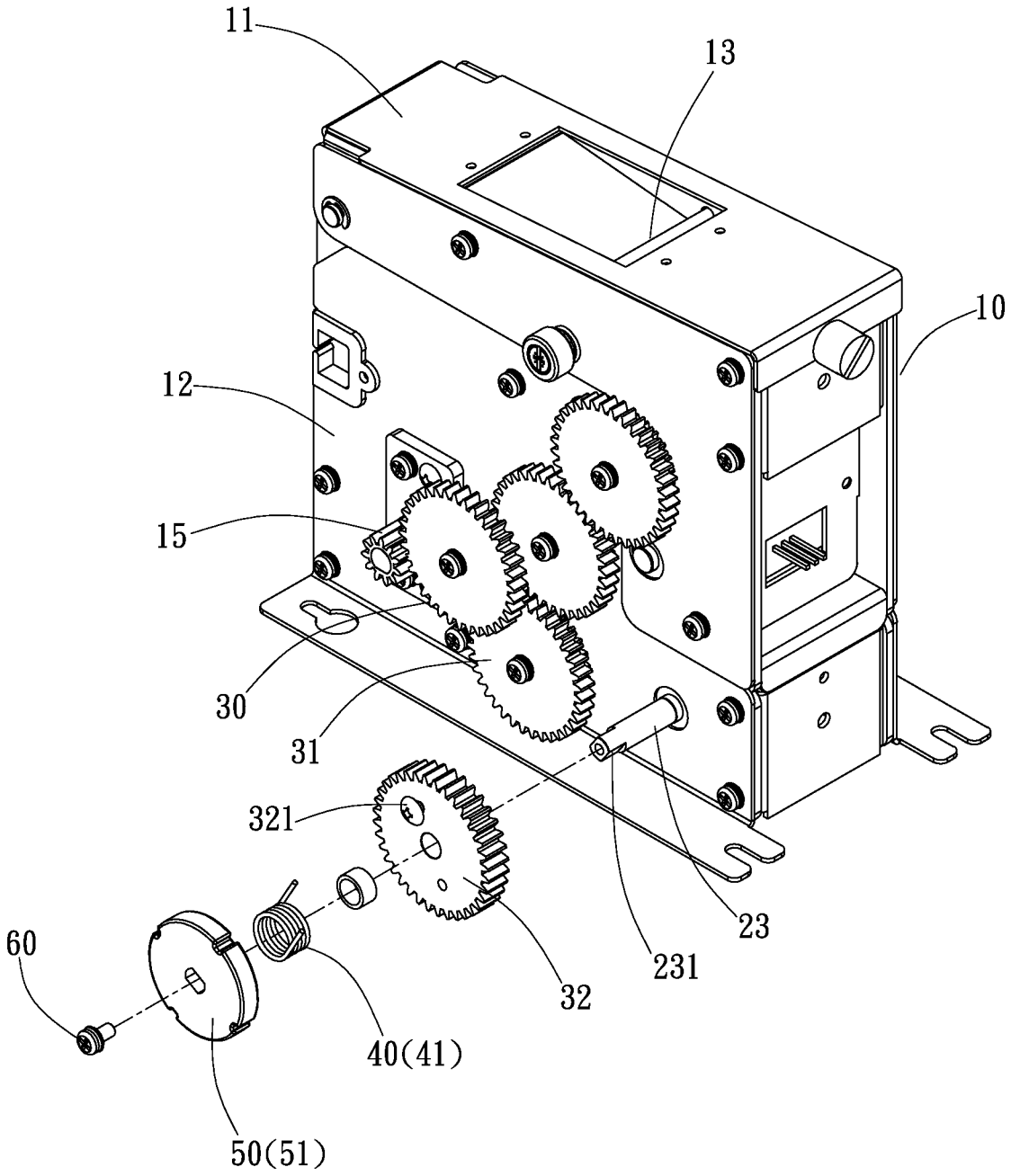
FIG. 8 is a schematic elevational view of the lottery ticket destroying device of the present invention with the elastic member thereof shown in exploded view.

Referring to FIG. 8, FIG. 9 and FIG. 10, one end of the shaft 23 of one of the two roller cutters (20 as illustrated) of the present invention is provided with a mounting portion 231. The mounting portion 231 extends to protrude from one side of the housing 10, and is located on the same side as the transmission gear set 30, and a second driven gear 32 of the transmission gear set 30, an elastic member 40 and a retaining member 50 are sequentially mounted on one end of the shaft 23. The elastic member 40 has one end thereof abutted against the second driven gear 32 and an opposite end thereof abutted against the retaining member 50. The retaining member 50 is coupled to the mounting portion 231 of the shaft 23. Thereby, the retaining member 50 is pushed by the elastic force of one end of the elastic member 40, so that the retaining member 50 pushes the roller cutter 20, causing one vertical shear surface 212 of the roller cutter 20 to mesh with one vertical shear surface 212 of the other roller cutter 20'. Therefore, the meshed vertical shear surfaces 212 of the two roller cutters 20,20' have room for flexible activity, which can prevent the jamming caused by two lottery tickets being simultaneously drawn into the two roller cutters.

Referring to FIGS. 8-10, the outer side of the second driven gear 32 is provided with a stopping portion 321, and the stopping portion 321 can be a screw attached to the second driven gear 32. The retaining member 50 is a disc 51 made of plastic. The inner side of the disc 51 has a latching portion 52. The latching portion 52 can be embodied as a recess recessed into the disc 51. The elastic member 40 is preferably implemented as a torsion spring 41. The torsion spring 41 has one end thereof abutted against the stopping portion 321 of the second driven gear 32, and an opposite end thereof abutted against the latching portion 52. In addition, a fixing component 60 can be attached to the end surface of the mounting portion 231. The fixing component 60 can be a screw, and the fixing component 60 can be pressed against an outer side of the retaining member 50 to prevent the retaining member 50 from coming off the mounting portion 231.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A lottery ticket destroying device, comprising a housing, two roller cutters mounted in said housing, each said roller cutter having a shaft protruding from two opposite ends thereof, said shaft being rotatably inserted through said housing, and a transmission gear set mounted on one side of said housing, said transmission gear set comprising a first driven gear and a second driven gear respectively mounted on said shafts of said roller cutters at one end, wherein:

said two roller cutters each comprise a roller cutter surface and a plurality of helical shear grooves recessed into said roller cutter surface, each said helical shear groove comprising a groove bottom surface, a vertical shear surface located on one side of said groove bottom surface and connected to said roller cutter surface and a chip-discharge surface located on an opposite side of said groove bottom surface and connected to said roller cutter surface;

said shaft of one of said roller cutters comprises a mounting portion protruding from one side of said housing and sequentially mounted with a second driven gear of said transmission gear set, an elastic member and a retaining member, said elastic member having one end thereof abutted against said second driven gear and an opposite end thereof abutted against said retaining member, said retaining member being coupled to said mounting portion of said shaft.

2. The lottery ticket destroying device as claimed in claim 1, wherein said chip-discharge surface is selectively a sloping surface or a curved surface.

3. The lottery ticket destroying device as claimed in claim 1, wherein said second driven gear comprises a stopping portion located on an outer side thereof; said retaining member is a disc comprising a latching portion located on an inner side thereof; said elastic member is a torsion spring, said torsion spring having one end thereof abutted against said stopping portion of said second driven gear and an opposite end thereof abutted against said latching portion.

4. The lottery ticket destroying device as claimed in claim 3, wherein said stopping portion is a screw attached to said second driven gear; said latching portion is a recess recessed into said disc.

5. The lottery ticket destroying device as claimed in claim 3, wherein said mounting portion has an end surface mounted with a fixing component, said fixing component holding down an outer side of said retaining member.

6. The lottery ticket destroying device as claimed in claim 5, wherein said fixing component is a screw.

* * * * *